United States Patent [19]

Hemmerling

[11] Patent Number: 4,461,120

[45] Date of Patent: Jul. 24, 1984

[54] PASS DOOR ASSEMBLY

[75] Inventor: Gene A. Hemmerling, Richmond, Ind.

[73] Assignee: American Metal Door Company, Inc., Richmond, Ind.

[21] Appl. No.: 502,334

[22] Filed: Jun. 8, 1983

[51] Int. Cl.[3] ..... E05D 15/48

[52] U.S. Cl. ..... 49/169

[58] Field of Search ..... 49/169, 168, 163, 170, 49/177, 178, 179, 180; 160/180, 116

[56] References Cited

U.S. PATENT DOCUMENTS

| | | | |
|---|---|---|---|
| 1,581,776 | 4/1926 | Altschul | 49/169 X |
| 2,759,227 | 8/1956 | Reid et al. | 49/169 X |
| 3,283,443 | 5/1964 | Kendrick et al. | 49/163 X |
| 4,217,731 | 8/1980 | Saino | 49/169 |

FOREIGN PATENT DOCUMENTS

| | | | |
|---|---|---|---|
| 89084 | 4/1957 | Norway | 160/180 |

*Primary Examiner*—Philip C. Kannan
*Attorney, Agent, or Firm*—Barnes & Thornburg

[57] ABSTRACT

A door for selectively covering an opening in a wall has at least one primary door panel movable to substantially cover the wall opening. The door panel has a rear surface facing the wall, an opposing front surface and a pass opening to permit passage therethrough. A frame borders the pass opening and includes a lock jamb having an offset door stop and a complimentary hinge jamb. A pass door for substantially covering the pass opening has a rear surface, a front surface, a first side edge and a second side edge. The first side edge of the pass door is hinged to the hinge jamb to permit the pass door to swing between an open position and a closed position against the offset door stop of the lock jamb. A pin for limiting lateral movement of the second side edge of the closed pass door relative to the lock jamb, has a proximal portion fixed to the offset door stop and a distal portion substantially perpendicular to the offset door stop for engaging the pass door when the pass door is in its closed position. The pass door also includes a latch for engaging the lock jamb to retain the pass door in its closed position.

7 Claims, 2 Drawing Figures

PASS DOOR ASSEMBLY

The present invention relates generally to a movable door for selectively covering an opening in a wall, and more particularly to an improved pass door assembly in the movable door for allowing passage therethrough when the wall opening is covered.

Slide type doors including pass doors for allowing passage therethrough when closed are known in the art. These slide type doors are commonly referred to as either "labeled" or "non-labeled" door assemblies. A "labeled" door assembly is defined as a combination of a door, hardware and other accessories which together provide a degree of protection to an opening when closed and to which has been attached a label to indicate compliance with nationally recognized standards or tests. All other slide type doors are referred to as "non-labeled" door assemblies.

One "labeled" fire door assembly including a pass door for passage therethrough is disclosed in U.S. Pat. No. 4,217,731. In this slide type fire door and pass door combination, peg means are attached to an edge of the pass door opposite the hinged coupling for engaging the fire door when the pass door is in the closed position to prevent separation of the edges of the pass door opening in the fire door and the pass door.

In the door assembly disclosed in U.S. Pat. No. 4,217,731, the swinging pass door has arm-like members attached to and projecting from the edge of the door opposite the hinges. The peg means are attached to the arm-like members. As the pass door swings from an open position to a closed position and vice versa, these arm-like members with the peg means present protrusions which can catch on clothing and other articles in proximity to the pass door as it is being opened and closed. As the pass door is opened and closed, the peg means move in an arc. Because of the projection of the peg means from the door and acuate path of movement openings provided in the fire door must be enlarged to receive the peg means. The enlargement of the openings result in a loose fit between the peg means and the openings when the pass door is closed. Further, the protrusion of the arm-like members from the pass door detract from the overall esthetic appearance of the total door assembly.

One object of the present invention is to provide a movable door with a pass door assembly which has a more esthetic appearance than conventional slide type door and pass door combinations.

Another object of the present invention is to provide a movable door with a pass door assembly not having any projections or protrusions which might catch or snag clothing or other articles in proximity to the pass door as it is being opened or closed.

Yet another object of the present inventin is to provide a movable door with a pass door assembly that is easier to assemble and provides improved limitation of movement of the pass door relative to the slide type door when the pass door is closed in comparison to conventional movable door and pass door assemblies.

In an illustrative embodiment of the present invention, a door for selectively covering an opening in a wall, includes at least one primary door panel which is movable to substantially cover the wall opening. The door panel has a rear surface facing the wall, an opposing front surface and a pass opening therethrough to permit passage through the primary door panel when the wall opening is covered. A frame borders the pass opening and includes a lock jamb having an offset door stop and a complimentary hinge jamb. A pass door for substantially covering the pass opening has a rear surface, a front surface, a first side edge, and a second side edge. The first side edge of the pass door is pivotally coupled to the hinge jamb by hinges to permit the pass door to swing between an opened position and a substantially closed position where the pass door is against the offset door stop of the lock jamb. Means for limiting lateral movement of the second side edge of the pass door relative to the lock jamb of the primary door panel when the pass door is in its closed position includes a pin having a proximal portion fixed to the offset door stop and a distal portion extending substantially perpendicular to the offset door stop for engaging the pass door in its closed position. The pass door further includes a latch means for engaging the primary door panel when the pass door is in its closed position.

In one illustrative embodiment, the pass door includes an aperture for receiving the pin when the pass door is in its closed position to prevent lateral separation of the lock jamb and the second side edge of the pass door.

In the illustrative embodiment, the offset door stop extends from the rear surface of the primary door panel into the pass opening so that the pin projects forward and is substantially perpendicular to the rear surface of the pass door when it is closed. The aperture is formed in the rear surface of the pass door. When the pass door is closed, the pin is received in the aperture as the pass door comes to rest against the offset door stop. The front surfaces of the primary door panel and pass door have no overlapping portions therebetween when the pass door is closed. Further, the pass door has no arm-like protrusions extending from its side edges.

Various other features and advantages of the present invention will become apparent in view of the following detailed description of one embodiment thereof exemplifying the best mode of carrying out the invention as presently perceived, which description should be considered in conjunctin with the accompanying drawings, in which.

Figure 1:
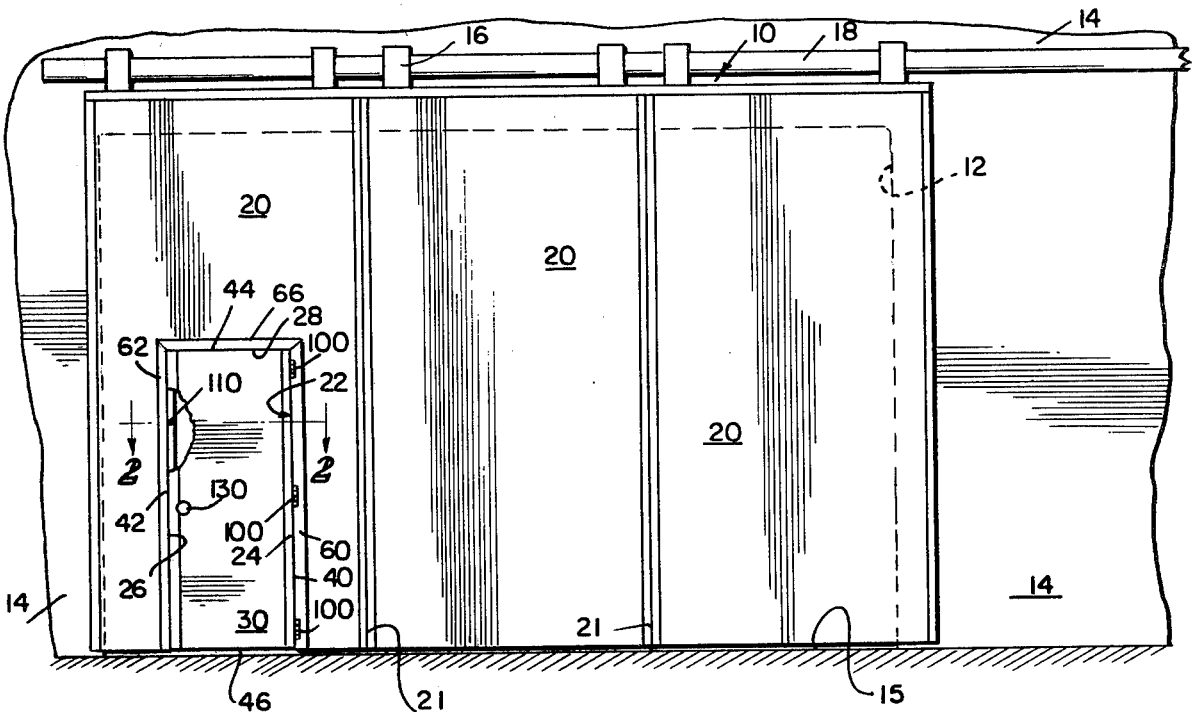
FIG. 1 is a front elevational view of movable door and pass door assembly embodying the present invention shown mounted to a wall and covering an opening in the wall.
Figure 2:
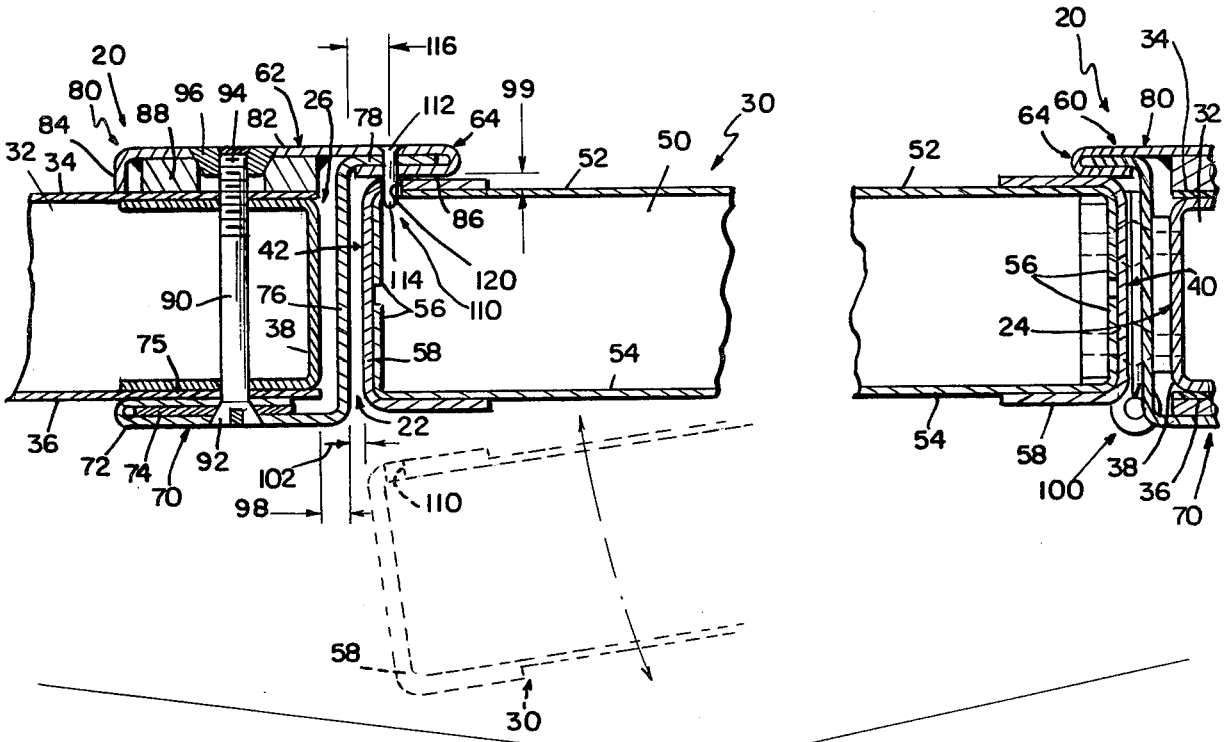
FIG. 2 is a section view through the pass door taken generally along lines 2—2 of FIG. 1.

A slide type movable door 10 with a pass door assembly 30 embodying the present invention is shown in FIGS. 1 and 2. Door 10 is for selectively covering an opening 12 in a wall 14. The door 10 may be slidably coupled to the wall 14 in any manner which will allow the door 10 to be moved between an open position so that opening 12 is substantially unobstructed, and a closed position where opening 12 is substantially covered. In the illustrative embodiment, door 10 is coupled to wall 14 by a plurality of trolleys 16 fixedly attached to the top of the door 10 which slidably engage an elongated rail 18 fixedly attached to the wall 14 above the opening 12. As particularly shown in FIG. 1, door 10 extends downwardly from rail 18 to the floor 15 to substantially cover opening 12 when door 10 is in its closed position and is slidable to the right to an open position.

Throughout the following detailed description, reference is made to door 10 including a pass door assembly 30 embodying the present invention. Door 10 including pass door assembly 30 may be either a "labeled" door or a "non-labeled" door without departing from the scope of the present invention. A "labeled" door is defined as a combination of a door, hardware and other accessories which together provide a degree of protection to an opening and to which has been attached a label indicating compliance with nationally recognized standards or tests. All other doors are referred to as "non-labeled" doors. The present invention is not intended to be limited to either a "labeled" or a "non-labeled" door.

In the illustrative embodiment, the primary door 10 includes a plurality of panel members 20 connected in edge-to-edge relationship by connectors 21 to form the primary door 10. It should be noted that the door 10 may be a single panel and the present invention is not intended to be limited to multiple panel doors. In many applications, door 10 may be quite large. To facilitate shipment of the door 10 and assembly at the site, the door 10 can be constructed in panel sections 20 which are connected at the site. While various connectors 21 could be used for connecting the panel sections 20, a preferred edge-to-edge connector is disclosed in application Ser. No. 306,002, filed Sept. 28, 1981, which is assigned to the same assignee as the present invention.

One of the primary door panels 20 has a pass opening 22 therethrough for allowing passage through door 10 when opening 12 is substantially covered by door 10. Pass opening 22 has a first side edge 24, a second side edge 26 and a top edge 28. The pass opening 22 is substantially the same shape and size as a pass door 30 for closing the opening 22.

The specific construction of each primary door panel section 20 may vary. In the illustrative embodiment, each composite panel section 20 includes an internal core 32 which may be constructed of insulative or fire resistant material for a "labeled" door 10 or of any other material for a "non-labeled" door 10. It will be appreciated that core 32 could also be hollow. A rear surface 34 for facing the wall 14 includes a relatively thin facing sheet of metal. An opposing front surface 36 also includes a relatively thin facing sheet of metal. Side edges 24 and 26 and top edge 28 of pass opening 22, are formed by generally U-shaped edge members of stiles 38 having legs extending into the core 32 along rear and front surfaces 34 and 36, respectively. The U-shaped edge members 38 extend vertically the length of side edges 24 and 26 and horizontally the length of the top edge 28 of pass opening 22.

The pass door 30 is substantially the same size and shape as pass opening 22. The pass door 30 has a first side edge 40, a second side edge 42, a top edge 44, and a bottom edge 46. Again, it will be appreciated that the specific construction of the pass door 30 may vary depending upon whether the combined door 10 and pass door 30 assembly is a "labeled" or "non-labeled" door. Referring particularly to FIG. 2, the composite pass door 30 includes an internal core 50 which may be constructed of insulative, fire resistant, or other material. A rear surface 52, and a front surface 54 of pass door 30, ech includes a relatively thin facing sheet of metal having ends 56 extending vertically along the side edges 40 and 42 of the pass door 30. The side edges 40 and 42 are capped by U-shaped armor plates or stiles 58 extending vertically the length of the side edges 40 and 42 and across the top edge 44.

A frame borders pass opening 22 and includes a first vertical frame member 60 providing a hinge jamb, a second vertical frame member 62 providing a lock jamb having an offset door stop 64 projecting into pass opening 22 in spaced parallel relationship to the rear surface 34 of panel section 20, and a top horizontal frame member 66 extending along top edge 28. Both of the vertical side frame members 60 and 62 are identically constructed. Each of the frame members 60 and 62 includes an edge frame section 70 having a front end portion 72 bent backward onto itself with a shim 74 interposed between the backwardly bent segment 75 and the remainder of end portion 72. End portion 72 engages front surface 36 of panel section 20. The end portion 72 and shim 74 extend vertically the length of side edges 24 and 26 of pass opening 22. A middle portion 76 of edge frame section 70 is in generally spaced parallel relationship to side edges 24 and 26 of pass opening 22. A rear end portion 78 of edge frame section 70 is bent away from side edges 24 and 26 and projects into pass opening 22 in spaced parallel relationship to the rear surface 34 of panel section 20 to form a part of the offset door stop 64.

Each frame member 60 and 62 also includes a rear frame section 80 including a planar middle portion 82 extending vertically the length of side edges 24 and 26 in generally spaced parallel relationship to rear surface 34 of panel section 20. A first end portion 84 is bent inward toward and engages rear surface 34. A second end portion 86 is bent backward onto itself and receives the rear end portion 78 of the edge frame section 70 to form the offset door stop 64. Preferrably, each section 70 and 80 of the frame is constructed of metal. Further, it will be appreciated that the top frame member 66, although not shown, preferrably has the same construction as that described above for side frame members 60 and 62.

Referring particularly to FIG. 2, shims 88 are interposed between the middle portion 82 of rear frame section 80 at locations where bolts 90 (jamb anchors) are employed for fixedly attaching frame members 60, 62, and 66 to side edges 24 and 26, and top edge 28, respectively. Bolt 90 has a head 92 and extends through front end portion 72 of edge frame section 70, through panel section 20 and has a threaded end 94 engaging a grommet nut 96. Head 92 and grommet nut 96 are flush with front end portion 72 of edge frame section 70 and middle portion 82 of rear frame section 80. It will be appreciated that a plurality of bolts 90 connected in the manner illustrated in FIG. 2 will be used as jamb anchors for attaching side frame members 60 and 62 to the panel section 20. Further, a similar attachment technique is preferrably used for attaching the top frame member 66 to panel section 20.

When side frame members 60 and 62 are attached, a space 98 of about 0.500 to 0.750 inch is provided between side edges 24 and 26 of pass opening 22, and the external surfaces of middle portion 76 of edge frame sections 70. The space 98 provides a mortise for a lock or other latching hardware and hinges. As also particularly shown in FIG. 2, the door stop 64 is spaced rearward from the rear surface 34 of panel section 20 a distance 99 of approximately 0.1875 inch.

Hinge means 100 attach the first side edge 40 of pass door 30 to the side frame member 60 (hinge jamb) and first side edge 24 of pass opening 22 to allow pass door 30 to pivot or swing in the directions of the arrows in FIG. 2 between a closed position (shown by the solid lines in FIG. 2) in which the pass opening 22 is substantially covered by the pass door 30, and an open position (shown by the broken lines in FIG. 2) in which the pass opening 22 is substantially unobstructed by the pass door 30. The hinge means 100 may be of any conventional construction. When pass door 30 is in its closed position, a space 102 of approximately 0.125 inch is provided between the external surface of armor plate 58 along side edges 40 and 42 of pass door 30, and the external surface of middle portions 76 of edge frame sections 70.

Means for limiting lateral movement of the second side edge 42 of pass door 30 relative to side frame member 62 (lock jamb), or side edge 26 of pass opening 22 when pass door 30 is in its closed position, is shown particularly in FIG. 2. The lateral movement limiting means includes one or more pins 110 having a proximal end 112 fixedly attached to the offset door stop 64 and a distal end 120 extending forward substantially perpendicular to the door stop 64, to engage the pass door 30 when the pass door 30 is in its closed position as shown in FIG. 2. The distal end 114 of pin 110 is preferably tapered for engaging the pass door 30 in the manner which will be explained later. Preferrably, three pins 110 are fixedly attached to the offset door stop 64 of vertical frame member 62 in the manner just described. In the illustrative embodiment, one pin 110 is located approximately 6.00 inches down from the top edge 28 of pass opening 22, another pin is located approximately 6.00 inches up from the floor 15, and a third pin 110 is located approximately 42.0 inches up from the floor 15. Pins 110 are attached to door stop 64 a distance 116 from the external surface of middle portion 76 of edge frame section 70. In an illustrative embodiment, distance 116 is approximately 0.625 inch.

Apertures 120 are formed in the rear surface or stop side 52 of pass door 30 which contacts the door stop 64. Apertures 120 are located in surface 52 so that they receive pins 110 when pass door 30 is in its closed position. Apertures 120 extend through the armor plate 58 and the metal sheet on the rear surface or stop side 52 of pass door 30 in proximity to the vertical side edge 42 of pass door 30.

In the closed position of pass door 30, portions of armor plate 58 extending along the rear surface or stop side 52, abut against offset door stops 24 provided by frame members 60, 62 and 66 to limit pivotal movement of pass door 30. With pass door 30 in its closed position, pins 110 are received in apertures 120 to limit lateral movement of vertical side edge 42 of pass door 30 with respect to vertical side edge 26 (frame member 62) of pass opening 22. Lateral movement of the side edge 42 relative to side edge 26 occurs particularly when door 10 is being moved between its opened and closed positions. Since offset door stop 64 extends substantially along side edges 24 and 26 and top edge 28 of pass opening 22, a seal may be provided between pass door 30 and frame members 60, 62 and 66 when pass door 30 is in its closed position and abutting against door stops 64. A latch means 130 is provided on pass door 30 for engaging frame member (lock jamb) 62 when pass door 30 is in its closed position to retain the pass door 30 in the closed position. Latch means 130 may be any conventional door knob or lock assembly for allowing pass door 30 to be opened from a closed position and to be substantially latched in the closed position.

Some of the advantages of a pass door assembly 30 embodying the present invention are particularly shown in FIG. 2. As pass door 30 is pivoted between its closed and open positions, there are no protrusions to snag or catch on objects, such as a person's clothing, in proximity to the pass door 30. Further, the cross-sectional dimension of apertures 120 can be substantially equal to the cross-sectional dimension of pins 110. As pass door 30 is being closed, apertures 120 swing through an arc. When pass door 30 is near its closed position, apertures 120 are substantially parallel to and in the same plane with pins 110. This is a significant advantage over a pass door assembly where pegs are attached to a swinging door and are moved in an arc, since the pegs project outwardly and thus scribe a greater arc which requires an aperture having a significantly greater cross-sectional dimension than the peg in order to receive the peg. It will also be appreciated that the overall esthetic appearance of the pass door assembly 30 embodying the present invention is enhanced by its structural features. These and other advantages are provided by a pass door assembly 30 embodying the present invention.

What is claimed is:

1. A door for selectively covering an opening in a wall, the door comprising: at least one primary door panel movable to substantially cover the wall opening, the door panel having a rear surface to face the wall, an opposing front surface, and a pass opening therethrough to permit passage through the primary door panel, a frame bordering the pass opening, the frame including a lock jamb having an offset door stop and a hinge jamb, a pass door for substantially covering the pass opening, the pass door having a rear surface, a front surface, a first side edge, and a second side edge, means for pivotally attaching the first side edge of the pass door to the hinge jamb to permit the pass door to swing from an open position to a substantially closed position against the offset door stop of the lock jamb, and means for limiting lateral movement of the second side edge of the closed pass door relative to the lock jamb, the limiting means including a pin, the pin having a proximal portion fixed to the offset door stop of the lock jamb and a distal portion extending substantially perpendicular to the offset door stop for engaging the pass door when the pass door is in the closed position and latch means for engaging the lock jamb to retain the pass door in its closed position.

2. The door of claim 1 further comprising means providing an aperture in the pass door for receiving the distal portion of the pin when the pass door is in the closed position.

3. The door of claim 2 wherein the door stop is offset rearwardly from and is generally parallel to the rear surface of the primary door panel and the aperture providing means is on the rear surface of the pass door in proximity to its second side edge.

4. The door of claim 3 wherein the pin extends forward from the door stop in generally spaced parallel relationship to the lock jamb.

5. The door of claim 2 wherein the pin is in spaced parallel relationship to the lock jamb and the aperture is provided in the pass door in proximity to the second side edge thereof to receive the pin when the pass door is closed against the door stop.

6. A door for selectively covering an opening in a wall, the door comprising: a primary door movable to substantially cover the wall opening, the primary door having a rear surface to face the wall and an opposing front surface, a pass opening in the primary door to permit passage therethrough when the opening is substantially covered, the pass opening having first and second side edges, a pass door to substantially cover the pass opening, the pass door having a rear surface, a front surface, a first side edge and a second side edge, hinge means for pivotally attaching the first side edge of the pass door to the first side edge of the pass opening to permit the pass door to swing from an open position to a closed position, means providing a door stop for engaging the rear surface of the pass door when it is in its closed position, a pin for engaging the rear surface of the pass door when the pass door is in the closed position, the pin having a proximal portion fixed to the door stop and a distal portion extending in generally spaced parallel relationship to the second side edge of the pass opening, means providing an aperture in the rear surface of the pass door for receiving the pin when the pass door is in its closed position to limit lateral movement of the second side edge of the closed pass door relative to the second side edge of the pass opening, and latch means for retaining the pass door in its closed position.

7. A door for selectively covering an opening in a wall, the door comprising: a primary door movable to substantially cover the wall opening, the primary door having a rear surface to face the wall and an opposing front surface, a pass opening in the primary door to permit passage therethrough when the opening is substantially covered, the pass opening having first and second side edges, a pass door to substantially cover the pass opening, the pass door having a rear surface, a front surface, a first side edge and a second side edge, hinge means for pivotally attaching the first side edge of the pass door to the first side edge of the pass opening to permit the pass door to swing from an open position to a closed position, a pin for engaging one of the surfaces of the pass door when the pass door is in the closed position, means for attaching the pin to the second side edge of the pass opening in fixed relationship to the primary door, means providing an aperture in the one surface adjacent the second side edge of the pass door for receiving the pin when the pass door is in its closed position to limit lateral movement of the second side edge of the closed pass door relative to the second side edge of the pass opening, and latch means for retaining the pass door in its closed position.

* * * * *